United States Patent [19]

Gäumann

[11] 4,253,942

[45] Mar. 3, 1981

[54] APPARATUS FOR THE SEPARATION OF MIXTURES OF PARTICULATE SOLIDS OF DIFFERENT DENSITY

[75] Inventor: Andreas Gäumann, Feldmeilen, Switzerland

[73] Assignee: Gesellschaft zur Förderung der Forschung an der Eidgenössischen Technischen Hochschule, Zurich, Switzerland

[21] Appl. No.: 48,721

[22] Filed: Jun. 15, 1979

[30] Foreign Application Priority Data

Jul. 14, 1978 [CH] Switzerland ..... 7655/78

[51] Int. Cl.[3] ..... B03B 7/00; B03B 5/66

[52] U.S. Cl. ..... 209/17; 209/161; 209/170; 366/241; 366/279; 366/341; 366/342

[58] Field of Search ..... 209/17, 168, 170, 158–161; 366/241, 279, 341, 342

[56] References Cited

U.S. PATENT DOCUMENTS

| | | | |
|---|---|---|---|
| 636,675 | 11/1899 | Latimer | 209/158 |
| 661,994 | 11/1900 | Jordan | 209/159 |
| 3,322,272 | 5/1967 | Evans et al. | 209/170 |
| 3,394,803 | 7/1968 | Kaye | 209/17 |
| 3,446,353 | 5/1969 | Davis | 209/170 X |
| 3,550,773 | 12/1970 | Villani et al. | 209/158 X |
| 3,993,290 | 11/1976 | Kovich | 366/241 X |

FOREIGN PATENT DOCUMENTS

| | | | |
|---|---|---|---|
| 18142 | 2/1914 | France | 209/159 |

*Primary Examiner*—Ralph J. Hill
*Attorney, Agent, or Firm*—Blanchard, Flynn, Thiel, Boutell & Tanis

[57] ABSTRACT

The present separation apparatus makes it possible at low cost continuously to separate a mixture according to the density of its constituent particles which have been graded to an upper limit of the particle size of any shape, and is particularly suitable for the separation of electrical storage battery waste. A separation medium, consisting preferably of a liquid and a gaseous flow medium, fed into a vertical separator column (1) via a mixing nozzle (10) flows through the column from the bottom upwardly. Above a constriction (7) adjacent a through-flow aperture (9) there is a baffle (15) which is movable transversely relative to the longitudinal axis (4) of separator column (1) to form a flow channel (20) leading to the through-flow aperture (9). The width of the flow channel (20) when the baffle (15) lies against the internal wall (1*a*) of the separator column (1) is just sufficiently large to let the particles through. The high flow velocity of the separating medium in the flow channel (20) as well as its continuous changes in shape caused by the baffle (15) result in an efficient separation of the mixture fed into the column through an upper, eccentrically arranged inlet opening (6). The heavy fraction (3) sinks into a lower collecting vessel (2) and the light fraction is discharged together with the outflowing separation medium through an upper outlet aperture (21).

16 Claims, 4 Drawing Figures

APPARATUS FOR THE SEPARATION OF MIXTURES OF PARTICULATE SOLIDS OF DIFFERENT DENSITY

BACKGROUND OF THE INVENTION

1. Field of the Invention

The invention concerns apparatus for the separation of two kinds of granular solid particles of any shape and of different density that have been graded to an upper limit of their grain size.

2. Description of the Prior Art

Many devices and apparatuses are already known for the separation of mixtures of solid particles of different density by means of flow media, e.g. for panning, elutriation, air sifting etc. A known and simple apparatus consists of a tubular counterflow separator column wherein the mixture fed in through an inlet aperture is exposed to the effect of a flow medium flowing through the tube from the bottom towards the top. The particles of lighter material are carried upwards by the flow medium and are discharged from the separating column together with the flow medium, through an upper outlet aperture while the particles of heavier material sink down in the flow medium and are collected in a collecting vessel at the bottom of the pipe.

It is common to all known separating apparatus that good separation results can only be achieved with mixtures of relatively uniform grain size and grain shape. Accordingly, therefore, the mixture of the raw material has to be pre-treated e.g. by grinding, grading, sifting etc. Such pretreatment renders the in itself simple separation of a mixture in a counterflow separator column elaborate and in most cases a multi-stage separating process is necessary to obtain satisfactory results.

SUMMARY OF THE PRESENT INVENTION

An aim of the invention is to provide separating apparatus with a counterflow separator column of the above-mentioned type wherein solid pieces widely differing in size and shape and of different density may be continuously separated in a single operation, the only precondition regarding the size of the particles in the mixture being that it should not exceed an upper limit.

According to the invention, this aim is sought to be achieved by a tubular separator column having a constriction above the lower collecting vessel to limit a through-flow opening, the upper side of the constriction forming a gliding surface, and below or within the through-flow aperture are arranged a mixing nozzle for at least two flow media and, above it, a chicane or baffle which is movable transversely relative to the longitudinal axis of the separator column and which in any of its end positions forms a flow channel with the diametrically opposite side of the inner wall of the separator column that leads to the through-flow aperture, with a maximum width equal to that of the through-flow aperture.

The flow channel formed by the random end position of the chicane or baffle movable transversely in relation to the longitudinal axis of the separator column towards the interior wall of the separator column corresponds as regards the ability of the mixture of particles to pass therethrough to a flow channel of annular cross-section that could be formed by a chicane or baffle rigidly mounted in the flow channel; however, in comparison with such an annular flow channel, the flow channel of the invention has a substantially smaller flow cross-section so that for the same flow medium throughput the flow velocity which is important for the separation of the mixture, is higher in the flow channel of the separating apparatus according to the invention than the flow velocity in a separator column with a fixed coaxial chicane or baffle or even with no chicane or baffle at all. The flow velocity in the separating apparatus according to the invention can, therefore, be easily set in such a way that the particles of the lighter material receive sufficient uplift from the flow medium flowing from the bottom upwardly to be flushed out through the outlet aperture and the particles of the heavier material receive only so little uplift that they all sink into the bottom collecting vessel. The residence time of the mixture in the separation zone, i.e. in the flow channel, has a substantial influence on the result of separation. In the separating apparatus according to the invention the relatively strong flow provokes irregular, rapid transverse blows in the chicane or baffle which creates favourable separation conditions in the flow channel such that the residence time required for satisfactory separation and thus the length of the separation section, can be made considerably shorter than in known separating apparatus of this type. Thus even in the case of a mixture of materials of only slightly different density, e.g. with a ratio of densities of 1:1.5, the length of the separation section need only be a few centimeters long. Under such conditions, the length of the separation section may without difficulty be set by adjusting the height of the chicane or baffle which preferably consists of one or more bodies of rotation coaxial with the longitudinal axis of the separator column, to an optimum for the consistency of the actual mixture to be separated. For the pretreatment of a mixture for separation in the separating apparatus according to the invention, all that is necessary is a grading of the mixture of granular particles to an upper limit of particle size, determined by the given width of the through-flow aperture and of the flow channel. If the mixture to be separated contains a powdery material consisting of very fine particles in addition to the granular material, the powdery material must be isolated before separation in the separating apparatus and separated in a conventional powder separation process. A further development of the invention relates to the separation of a raw material mixture containing a small portion, up to approximately 20% of powdery material. In the separating apparatus according to the invention the powdery material tends to settle on the mobile chicane or baffle which, after a certain amount of time could lead to a narrowing and eventual blocking of the flow channel by the granular material. Experience has shown that such deposit of the powdery material can be effectively avoided if at least one liquid flow medium, in the simplest case e.g. water, and at least one gaseous flow medium, e.g. air, are mixed by the mixing nozzle, whereby the nozzle orifices for the gas outlet of the mixing nozzle are preferably arranged in the centre of the mixing nozzle and the nozzle orifices for the outlet of the liquid medium are on the periphery of the mixing nozzle. Moreover, the end face of the chicane or baffle facing the through-flow aperture may have a convex surface. Expediently therefore, the rotationally symmetrical chicane or baffle body, or the lowermost one in the separator column when there is a plurality thereof, consists of a sphere which is freely movable in the separator column and its upward movement can be limited by an abutment in such a way that in addition to its transversal movement relative to the longitudinal axis of the separator column it can also rotate, thus even more effectively impeding the settling of the powdery material on the chicane or baffle. An inlet aperture for the mixture arranged eccentrically relative to the longitudinal axis of the separator column for the feeding-in of the mixture has proved to be beneficial both for an easier separation of the mixture and for the avoidance of blockages in the flow channel.

The powdery material is carried upwardly together with the granular substance of lighter material and discharged through the outlet aperture. A portion, even though only a small portion, of the heavier powder particles reaches the lower collecting vessel, so that the discharged powder slurry is enriched in particles of ligher material. By mixing a gaseous flow medium to a liquid flow medium to prevent deposit of powder on the chicane or baffle, the conditions created for the powdery substances in the separator column correspond to the conditions of flotation. Separation boosting additives, e.g. flotation agents, can be added to the fluid flow media, and these additives can be selected so that the light powdery component should predominate in the discharge slurry. Expediently a separator plant is connected to the outlet aperture in which the solid particles are separated from the flow medium e.g. by a screen; the separator plant can be equipped mechanically to separate the discharged powder slurry from the discharged granular substance.

The separated slurry can then be recycled back into the separator column again so that the proportion of heavy powder in the discharged slurry gradually decreases and eventually becomes negligible. For the operation of the separator column, the mixing nozzle is expediently connected to a feed plant for the supply of the flow media, which can include regulators for the control as regards the quantity and/or the pressure and/or the mixture ratio of the supply of the flow media to the mixing nozzle. The feed plant can be connected to the separator plant for receiving the flow medium discharged by it and it can be set up to create a circulatory movement of the liquid flow medium or of the mixture of flow media.

BRIEF DESCRIPTION OF THE DRAWINGS

In what follows, there is described a separation apparatus usable, by way of example, for the separation of electrical storage battery waste and illustrated in the accompanying drawings of which the individual Figures show.

The processing of storage battery waste yields a mixture consisting of pieces of hard lead (approximate density 11) and various pieces of plastics (approximate density 1 to 1.4) used for the casing and separator plates. This mixture graded to the upper limit (from fine powder up to pieces of approximately 20 mm) contains filamentary, latticed, cubical and lamellar particles.

With the separating apparatus according to the invention, this very heterogeneous mixture may be continuously separated in one process step, wherein the heavy fraction is obtained as hard lead free from plastics materials and the light fraction is elutriated as a coarse lead-free plastics fraction with a particle size of over 0.5 mm and a powder fraction (5–10% by weight) consisting of plastics "flour" and very fine lead powder.

Figure 1:
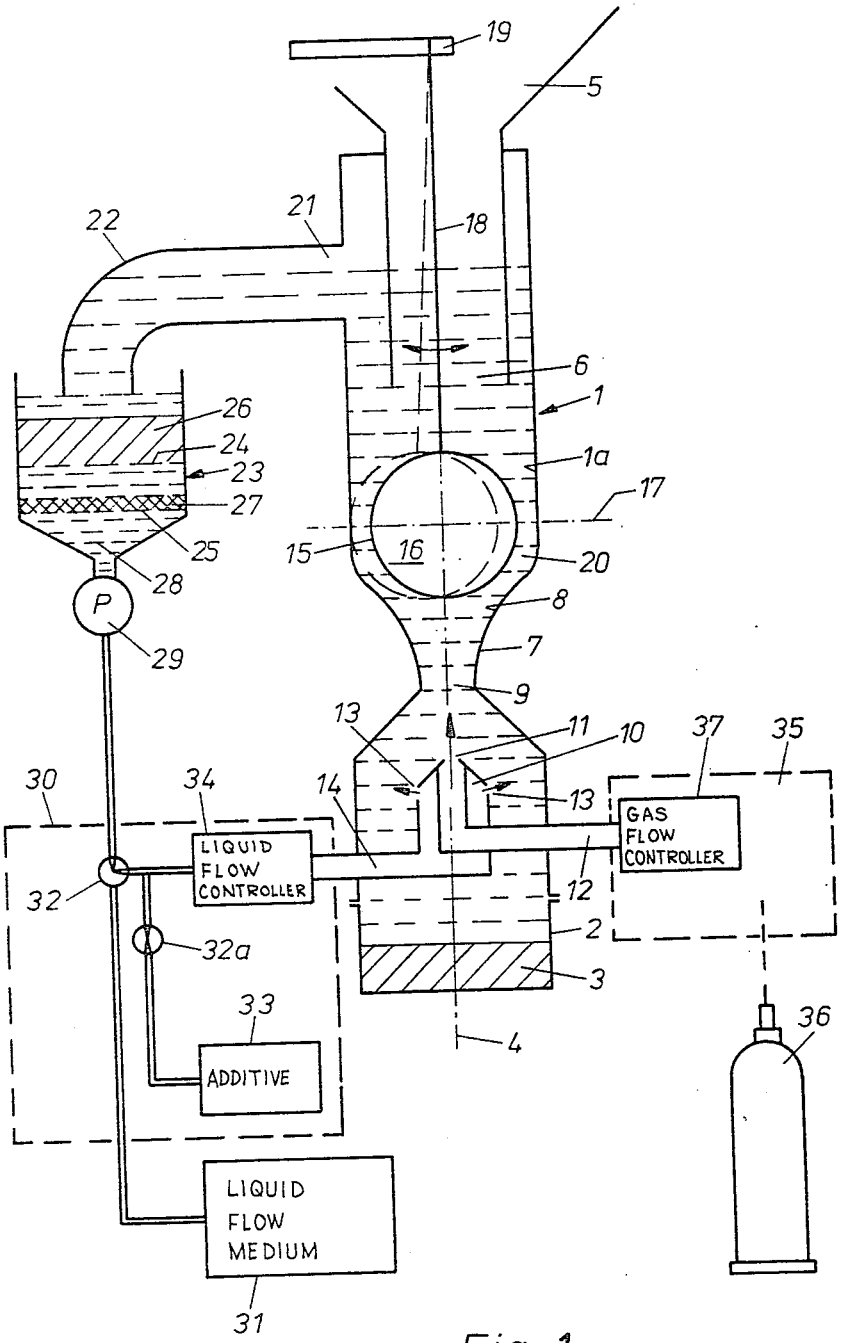
FIG. 1 is a diagrammatic representation of separating apparatus according to the invention, including a separator column in which a sphere is movably suspended to act as a chicane or baffle.

The separating apparatus diagrammatically illustrated in FIG. 1 consists of a stationary vertical tubular separator column 1 with a collecting vessel 2 at its lower end, which vessel is either detachable or is fitted with (non-illustrated, because conventional) means for discharging the heavy fraction 3. The longitudinal axis of the separator column is indicated by 4. A funnel 5 is mounted at the upper end of the separator column 1, for feeding the mixture in, the arrangement being such that the inlet aperture 6 is eccentric with respect to the longitudinal axis 4. The separator column 1 has a constriction 7 formed by a ring-shaped internal collar or by a inward projection bordering on a coaxial through-flow aperture 9. The diameter of the through-flow aperture 9 is somewhat (20–25%) larger than the upper limit of particle size in the mixture to be separated and amounts in the described example to approximately 25 mm.

The constriction 7 forms on its upper side a sliding surface 8 for the particles of the mixture with an inclination of e.g. 45°; it is smooth and has no edges to impede the sliding of the particles. In this region, the separator column 1 has an hour-glass shape. Below the through-flow aperture 9 a mixing nozzle 10 is arranged which in the described embodiment is provided with one or more jet or nozzle orifices 11 for the delivery of a gaseous flow medium, particularly air, and one or more jet orifice(s) 13 for the delivery of a liquid flow medium e.g. water, wherein the jet orifice(s) for gas are arranged centrally and the jet orifice(s) for liquid are arranged circumferentially. Respective pipe lines 12, 14 lead to the jet orifices 11 and 13 to carry the flow media therethrough to the jet orifice(s).

Above the through-flow aperture 9 a chicane or baffle 15 movable transversely relative to the longitudinal axis 4 of the separator column is disposed. In the illustrated embodiment, the movable chicane or baffle 15 consists of a solid sphere 16 or a hollow sphere, which is suspended for the purpose of allowing random lateral movements by means of suspension means 18, e.g. by a rigid rod pivotally journalled on a carrier 18, or a slightly spring rod, or a filament (when the sphere is of sufficient weight), etc. the diameter of the sphere being smaller by the size of the diameter of the through-flow aperture 9 than the internal diameter of the separator column 1. The chicane or baffle 15 forms a flow channel 20 with the internal wall 1*a* of the separator column 1 and the sliding surface 8 of the constriction 7, leading upwardly from the through-flow aperture 9 and having an annular flow cross-section in the equatorial plane 17 of the sphere 16 which constantly changes as the sphere 16 moves, but its surface area remains constant.

In any random end position of the sphere 16 at the internal wall 1*a* of the separator column 1, the flow channel 20 has a sufficient width for the passage of the largest particles of the mixture to be separated on the side opposite to the point of contact. The weight of the sphere 16 and its support in the separator column 1 are to be chosen in such a way that during operation of the separating apparatus according to the invention the lateral movements may take place easily and unimpeded, i.e. the sphere 16 should not be stabilised in its rest position by the effect of the above-described suspension and by the upwardly flowing media, and the sphere 16 should not in its end position be impeded by the passage of the largest particles of the mixture by reducing the width of the flow channel 20. The support of the sphere 16 may also be designed in such a manner as to allow it to rotate around an axis of rotation provided by the means of support 18 or so as to be settable into rotation by means of a flexible shaft as the support element and/or so as to permit the sphere to carry out additional up and down movements in a certain range of height.

Figure 2:
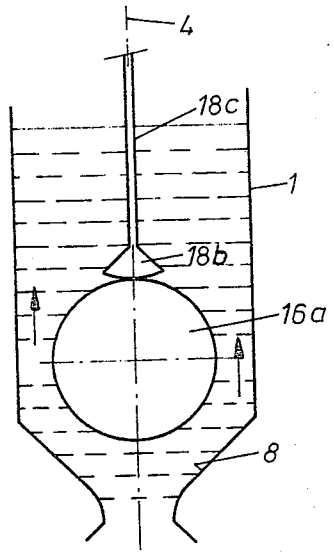
FIG. 2 shows a chicane or baffle consisting of a freely movable sphere that abuts against an upper stop.

FIG. 2 shows a sphere or a hollow sphere 16*a* as a chicane or baffle 15, the weight of which is so dimensioned that it is pressed lightly by the upwardly streaming flow media against an upper stop 18*b* which permits an unimpeded movement of the (hollow) sphere 16*a* and consists e.g. of the thickened end of a rod 18*c* arranged rigidly in and coaxially with the separator column 1.

Above the input aperture 6 (FIG. 1) the separator column 1 has a lateral outlet aperture 21 through which the liquid medium charged with the light fraction is discharged.

In the flow channel 20 from the through-flow aperture 9 to the equatorial plane 17 of the sphere 16, due to the relatively small flow cross-section in this region of the separator column 1, the liquid flow medium has a very high flow velocity which falls rapidly above the equatorial plane 17 to a level determined by the quantity of through-flow per second and the flow cross-section of the separator column 1 above the sphere 16. The separation of the mixture takes place in the region of the (hollow) sphere 16, where the granular particles of the light fraction attain an upwardly directed movement, while the granular particles of the heavy fraction are merely slowed down in their downwardly directed movement. In the present example, a certain amount of the powdery substance which is present in the mixture to be separated gets into the flow channel 20 and due to the upwardly flowing flow medium would in part deposit on the underside of the sphere. The gaseous flow medium mixed with the liquid flow medium in the mixing nozzle 10 prevents such deposits from forming in a generally satisfactory manner. The previously mentioned additional movements of the sphere 16, such as small up-and-down and/or rotary movements also work favourably towards keeping the surface of the sphere clean.

The lateral outlet aperture 21 is connected via a connecting pipe line 22 to a separator plant 23. The separator plant 23 receives from the separator column 1 the outflowing liquid flow medium 28 loaded with the granular light fraction 26 and the powdery material 27 and has means for physically or mechanically separating these components, e.g. screens 24, 25. The granular light fraction 26 contains only plastics particles and the powder fraction is composed of plastics flour and very fine lead powder, whereby the powder fraction is enriched in plastics flour.

The mixing nozzle 10 is connected to a supply plant 30 for at least one liquid flow medium, and the present embodiment for the separation of storage battery waste, also to a supply plant 35 for at least one gaseous flow medium. The sources 31, 36 of the respective flow media are connected to the supply plants 30 and 35 which latter include controllers 34, 37 for the control of the supply of the individual flow media independently of each other or of the supply of a mixture of liquid flow media and/or of a mixture of gaseous flow media to the mixing nozzle 10 as regards volume and/or pressure and/or mixture ratio. The liquid flow medium coming from the separator plant 23 is kept in circulation preferably by a pump 29 through the separator column 1 via the supply plant 30. If a plurality of liquid flow media is used, a mixture of these is provided from the separator plant. One or more additives promoting the separation in the separator column can be added to the liquid flow medium or media. Such additives are best known from the technology of separation by flotation. In that case, the supply plant 30 can be fitted with a storage tank 33 for each additive and can be equipped in such a way that via means of dispensing 32, 32*a* controlled by the controller 34 a mixture of the pure liquid flow media from source 31 and of the flow media from the separator plant 23 a liquid of constant composition is obtained for the mixing nozzle 10. Since generally only a few flow media are sufficient, e.g. in the simplest case of the above-described example of separation of storage battery waste, water as the liquid flow medium and air as the gaseous flow medium, full automation of the separation can be achieved without difficulty and with low costs by suitably designing the supply plants 30, 35 for a continuous separation process, where the supply plants can be assembled from commercially available components. In order to achieve high separation outputs, "batteries" of plants consisting of a plurality of series-connected separation columns can be assembled.

The above-described separator column of relatively short separation zone defined by the spheres 16, 16*a* as a chicane or a baffle is suitable for the separation of other mixtures without altering its construction, whereby through selecting suitable flow media and, optionally, the additives as well as the control conditions (controllers) optimal separation of the actual mixture may be easily set. Other mixtures, particularly those consisting of materials with little difference in density require a longer separation zone for efficient separation. Such longer separation zones can be realised by a corresponding construction of the design of the chicane or baffle.

Figure 3:
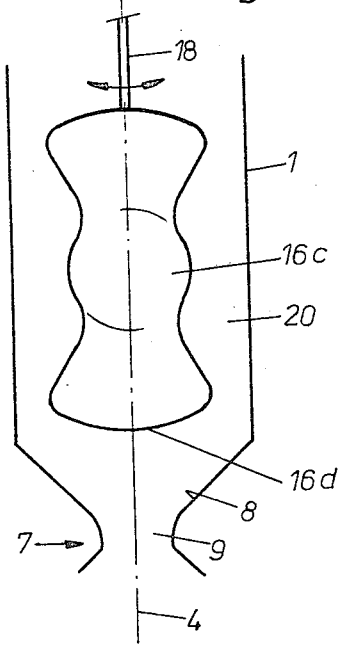
FIG. 3 shows a chicane or baffle consisting of a lengthwise extended body of rotation for use with a relatively long separation zone.
Figure 4:
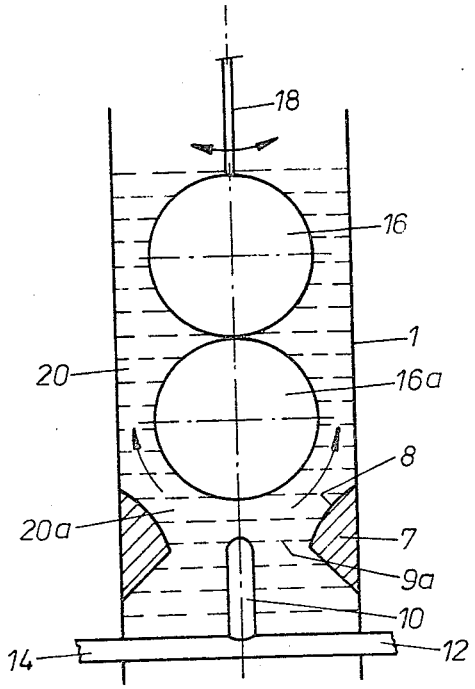
FIG. 4 illustrates a chicane or baffle for a long separation zone consisting of two spheres arranged one on top of the other.

FIGS. 3 and 4 illustrate two examples of embodiments of this kind. The chicane or baffle for a longer separation zone illustrated in FIG. 3 consists of a nearly dumb-bell shaped body of rotation 16*c* suspended e.g. on a slightly springy rod 18. The end face 16*d* of the chicane or baffle facing the through-flow aperture 9 is convexly arcuate in order to impede the formation of a deposit of particles. The continuously changing flow cross-section of the flow channel 20 along the longitudinal extent of the chicane or baffle 16*c* enhances the separation effect.

FIG. 4 shows a chicane or baffle consisting of two mutually superposed spheres 16, 16*a*. The upper sphere 16 is, as was described in conjunction with the separator column according to FIG. 1, suspended e.g. from a slightly springy rod 18, and forms, similarly to the embodiment according to FIG. 2 a stop for the lower freely movable sphere 16*a*. The mixing nozzle 10 is in this case arranged in the through-flow aperture 9*a*. The through-flow aperture 9*a* is thus of an annular shape wherein the width of the annulus must be at least equal to the upper limit of the particle size in the mixture. In comparison with a circular through-flow aperture (FIG. 1) the particle throughput of the annular through-flow aperture 9a is higher but the flow velocity is lower so that the lower section 20a of the flow channel in the region of the sliding surface 8 contributes less to the separation of the mixture. For a mixing nozzle arrangement of this kind a longer separation zone is therefore more advantageous.

For any particular mixture the chicane or baffle and its suspension providing optimum separation may easily be found by experiment. Since due to the possible variations in operating conditions and in the selection of flow media with only one kind of chicane or baffle, many different mixtures may be satisfactorily separated and also because many different shapes of the chicane or baffle yield equivalent separation results, generally only a few basic shapes of chicane or baffle are required to achieve separation of a very wide range of differing mixtures. The chicane or baffles and constrictions (e.g. in ring shape) may be constructed for interchangeability thus rendering not only the manufacture of the separating apparatus more economic but also substantially widening the field of application of a given separator column.

What I claim is:

1. Apparatus for the separation of a mixture containing two kinds of granular solid particles of any shape and of different density graded to an upper limit of grain size, comprising an upright elongated counterflow separator column through which a flow medium passes upwardly in use, the upper region of said column having an inlet aperture for feeding into said column the mixture to be separated and an outlet aperture for discharging from said column the flow medium containing solid particles of lower density, a collecting vessel connected to the lower end of said column for collecting the solid particles of higher density, a downwardly convergent constriction in the said column above the lower collecting vessel and having a through-flow aperture at its lower end, the upper surface of said constriction serving as a sliding surface for the solid particles, a mixing nozzle located beneath or within the through-flow aperture for flowing at least two flow media upwardly through said constriction, at least one baffle located in said column directly above said constriction and below said inlet aperture and said outlet aperture, said baffle being of smaller cross-sectional size than said column and being disposed in said column for transverse movement relative to the longitudinal axis of said column between random end positions wherein in any one of said end positions said baffle abuts against one portion of the inner wall of said column and is transversely spaced from the diametrically opposite side of the inner wall of said column whereby to define a flow channel between said baffle and said diametrically opposite side of the inner wall of said column, said flow channel leading to said through-flow aperture and having a maximum width which is identical with that of said through-flow aperture.

2. Apparatus according to claim 1, wherein said baffle comprises at least one body which is symmetrical about the longitudinal axis of said separator column and is coaxial therewith and has a convex end surface facing said through-flow aperture.

3. Apparatus according to claim 1 or claim 2, including means suspending said baffle in said column so that said baffle is supported at a position which is vertically upwardly spaced from said constriction for transverse movement relative to the longitudinal axis of said column.

4. Apparatus according to claim 3 in which said suspending means is a pivotally mounted rod, a resilient rod or a filament.

5. Apparatus according to claim 3 in which said baffle is a sphere.

6. Apparatus according to claim 3 in which said baffle comprises a vertically elongated body which is symmetrical about the longitudinal axis of said column and is coaxial therewith, said body having a convex lower surface facing said constriction.

7. Apparatus according to claim 1, wherein said baffle is a sphere.

8. Apparatus according to claim 7, wherein said sphere is freely movable and an abutment is provided to limit its upward movement in said column.

9. Apparatus according to claim 1, wherein said inlet aperture for feeding the mixture into said separator column is arranged eccentrically relative to the longitudinal axis of said separator column.

10. Apparatus according to claim 1, wherein said mixing nozzle is connected to supply plants that include controllers to control the supply of the mixing nozzle with flow media according to the volume and/or the pressure and/or the ratio of the mixture.

11. Apparatus according to claim 10, wherein said mixing nozzle is provided with first centrally located jet orifice means and with second peripherally located jet orifice means, said first centrally located jet orifice means being connected via a first pipeline to a source of gaseous flow media and said second peripherally located jet orifice means being connected via a second pipeline to a source of a liquid flow medium.

12. Apparatus according to claim 10, wherein said mixing nozzle together with the supply plant for the supply of liquid flow media is connected to said separator plant which separator plant is connected to said outlet aperture and includes means for separating solid particles from the flow medium so that the separated flow medium is recirculated to said mixing nozzle.

13. Apparatus according to claim 1, wherein at least one of said flow media is a liquid and at least one other of said flow media is a gas.

14. Apparatus according to claim 13, wherein the liquid flow medium contains an additive for promoting the separation.

15. Apparatus according to claim 1, wherein said outlet aperture extends laterally from said column and is located above said baffle and above said inlet aperture and said outlet aperture is connected via a connecting pipeline to a separator plant for the separation of the solid particles from the flow medium.

16. Apparatus according to claim 15, wherein said separator plant comprises mechanical or physical separation means for separating the discharged solid particles into a granular material and a slurry consisting of the finest particles.

* * * * *